United States Patent [19]

Teichner

[11] Patent Number: 4,887,536

[45] Date of Patent: Dec. 19, 1989

[54] SELF-CONTAINED, COLLAPSIBLE DEMONSTRATION TABLE WITH A BACKBOARD, FOR USE IN PRODUCT DEMONSTRATIONS

[75] Inventor: Marshall I. Teichner, Chicago, Ill.

[73] Assignee: Minatur Promotions and Enterprises, Ltd., Chicago, Ill.

[21] Appl. No.: 214,315

[22] Filed: Jul. 1, 1988

[51] Int. Cl.[4] ..... A47B 3/87

[52] U.S. Cl. ..... 108/35; 108/38

[58] Field of Search ..... 108/35, 36, 38, 33

[56] References Cited

U.S. PATENT DOCUMENTS

| | | | |
|---|---|---|---|
| 564,711 | 7/1896 | O'Brien | 108/35 |
| 1,850,636 | 3/1932 | Schauber | 108/35 X |
| 2,358,883 | 9/1944 | Rothschild | 108/35 X |
| 2,827,352 | 3/1958 | Boyajian | 108/35 X |
| 3,049,825 | 8/1962 | Boyd | 108/35 |
| 3,828,695 | 8/1974 | Skarky | 108/33 X |
| 4,143,601 | 3/1979 | Pike | 108/35 |
| 4,378,828 | 4/1983 | Shiminski | 108/35 X |

*Primary Examiner*—Peter A. Aschenbrenner

*Attorney, Agent, or Firm*—Cooper & Dunham

[57] ABSTRACT

A self-contained, collapsible demonstration table with a backboard, for use in product demonstrations and displays. The structure can be conveniently changed manually between a closed, suitcase-like structure which is easily stored and carried and an open table with a large table top and an upstanding display background.

5 Claims, 12 Drawing Sheets

SELF-CONTAINED, COLLAPSIBLE DEMONSTRATION TABLE WITH A BACKBOARD, FOR USE IN PRODUCT DEMONSTRATIONS

BACKGROUND AND SUMMARY OF THE INVENTION

The invention is in the field of collapsible tables and relates particularly to collapsible tables of the kind particularly suitable for product demonstrations and displays.

One merchandizing technique is to promote a product at a temporary demonstration and display set up in a store or a shopping mall where a demonstrator shows potential customers what the product is and perhaps how it can be used and where it can be bought. Typically, the demonstrator is at the location only temporarily and needs a temporary demonstration table or counter and perhaps a temporary display backboard. Sometimes such demonstrators can make temporary use of counter space which is normally used for other purposes. However, it is believed that usually it is undesirable to disrupt the normal use to which such counter space is put and, accordingly, typically a temporary table or a similar temporary structure is be set up especially for the demonstration and is later taken down. There are certain desirable but often incompatible features of such a temporary structure. For example, the structure should be light, so that it could be carried easily but at the same time it should provide a stable and sturdy table surface and, in addition, should look that way to give the visual appearance of quality. The structure should be small when not in use so that it could be stored and transported easily but when in use should have a large table top, to afford the demonstrator a large working surface, and should have a large display backboard so that it could be seen from afar and so that enough merchandise and/or directions and/or literature can be supported on the backboard. The structure should be easy and fast to assemble and disassemble, preferably without the need for any tools, but its components should be tightly and securely held together both when the structure is stored or transported and when it is used by a demonstrator.

An object of the invention, therefore, is to overcome the disadvantages of the prior art in meeting these and other conflicting requirements and to provide a demonstration table and a backboard which are particularly suited for a wide variety of displays and demonstrations at locations such as stores and shopping malls, which is particularly convenient to carry, set up and disassemble by one person, and which is particularly effective for its purpose.

In an exemplary embodiment of the invention, these and other objects of the invention are met by a structure which comprises a self-contained, collapsible demonstration table with a backboard which can be conveniently changed manually between a closed, suitcase-like structure that is easily stored and carried and a table with a large table top and an upstanding display backboard. The structure has a housing made up of a first shell and a second shell each of which has a hinge side and a free side separated from each other by a table portion having an inner side and an outer side. A shell hinge secures the hinge sides of said shells to each other to allow the shells to pivot between an open position in which the outer sides of said table portions of the shells form a substantially flat table top and a closed position in which the shells form a closed, suitcase-like package in which the inner sides of said table portions are spaced from each other to enclose an interior space. The structure further includes two leaves each having a hinge end and a free end, with a leaf hinge securing the hinge ends of said leaves to each other to allow the leaves to pivot between an open position in which said leaves form a display backboard and a folded position in which said leaves are folded flat against each other. To use the backboard for display, the housing has a backboard engaging means for detachably securing said backboard in a display position in which said backboard extends up from said table top. To secure the backboard to the shells for carrying and storage, the housing has a leaf engaging means for engaging said leaves when in their folded position to support them against the table portion of one of said shells when the shells are in their closed position. Each of the shells has leg engagement means at its inner side, and there are at least three legs each of which comprises an upper and a lower section which are secured to each other and to a respective leg engagement means by a respective resilient means which urges the respective leg sections and leg supporting means toward each other. When the respective leg sections and leg engagement means are aligned the two sections of each leg detachably interfit to form a leg and the legs detachably interfit with the respective leg engagement means to thereby support said table. The legs can be detached from said leg engagement means and the sections of each leg can be detached from each other by hand against the urging of said resilient means. The shells have at their inner sides leg section braces to detachably secure said leg sections flat against the inner sides of said shells when the leg sections are detached from each other. The suitcase-like package can be conveniently converted manually to a demonstration table with an upstanding display backboard by the steps of manually detaching the leaves, pivoting the shells to their open positions to form said table top, and detaching said leg sections from said braces and interfitting them with each other and with said leg engagement means to form table legs supporting the table top and pivoting the leaves to form said backboard and securing the backboard to said backboard engaging means. The table and backboard can be collapsed to form said closed, suitcase-like package by carrying out said steps in reverse order. Each of said shells includes a handle portion at its free end. These handle portions interfit when the shells are in their closed position to form a carrying handle. Straps of a material such as Velcro are secured to the free end of at least one of said shells for detachably engaging the other shell when the shells are in their closed position to keep said package closed. The free ends of the shells are rounded and said hinge ends are substantially flat so that when the shells are in their closed position the flat ends form a base on which the package can sit and said rounded ends form a rounded upper end of the package. The structure includes a drawer which is below the said table top when the shells are in their open position and fits within said interior space between the table portions when the shells are in their closed position.

BRIEF DESCRIBING OF THE DRAWINGS

DETAILED DESCRIPTION

Figure 1:
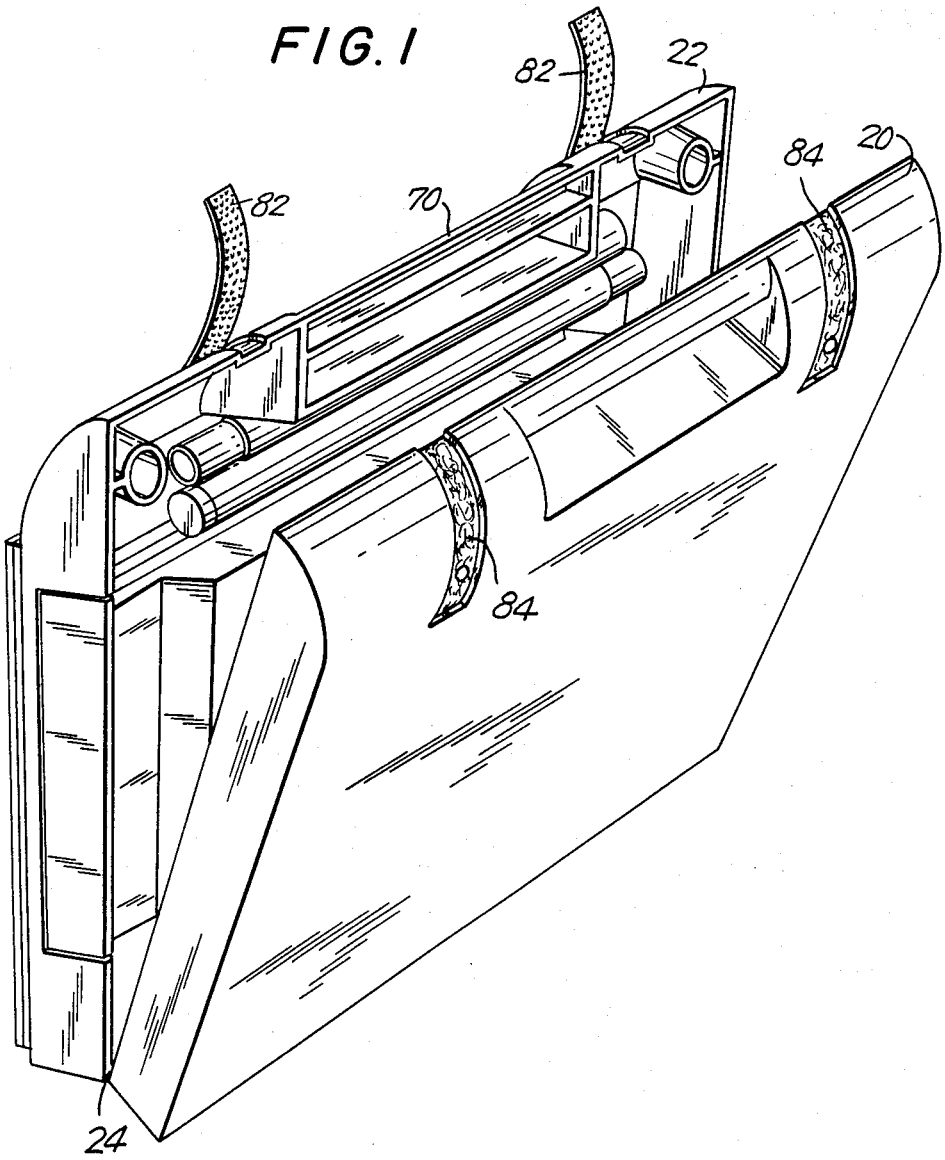
FIG. 1 is a perspective view of a table which is in accordance with an example of the invention and is just being opened.

An exemplary embodiment of a demonstration and display table in accordance with the invention comprises a first shell 20 and a second shell 22. First shell has a hinge side 20*a* and a free side 20*b* which are separated from each other by a table portion 20*c*, and second shell 22 similarly has a hinge side 22*a* and a free side 22*b* which are separated from each other by a table portion 22*c*. First shell 20 and second shell 22 are secured to each other at their hinge ends by a shell hinge 24 such that they can pivot between a closed position (FIG. 2) in which first shell 20 and second shell 22 form a closed, suitcase-like package and an open position (FIG. 4) in which the outer sides of table portion 20*c* and table portion 22*c* form a substantially flat table top 26.

Attached to the outside of first shell 20 are a leaf 28 and a leaf 30. Leaf 28 has a hinge end 28*a* and a free end 28*b* and leaf 30 similarly has a hinge end 30*a* and a free end 30*b*. A leaf hinge 32 secures leaf 28 and leaf 30 to each other such that leaf 28 and leaf 30 can pivot between an open position (FIG. 5) in which they form a substantially flat display backboard 34 and a folded position (FIG. 2) in which leaf 28 and leaf 30 are folded flat against each other. In order to detachably secure display backboard 34 to table top 26 in a display position, first shell 20 has a backboard engaging means in the form of a slot 36 into which leaf 28 can fit such that display backboard 34 extends up from table top 26 and is slightly inclined away from table top 26 as one moves up along display backboard 34. Note that leaf hinge 32 is at the adjoining edges of leaf 28 and leaf 30 in the configuration seen in FIG. 2, and that when display backboard 34 is in its display position on table top 26, projections 38 and symmetrically positioned but not seen projections 40 at the other corner of leaf 28, as well as a lip 42, face away from table top 26, and hence display backboard 34 remains flat in its display position without the need for braces to keep it that way. However, if desired, suitable braces can be provided to secure leaf 28 and leaf 30 to each other such that they cannot fold until such braces are removed. In order to carry leaf 28 and leaf 30 with the closed table, first shell 20 is provided with a leaf engaging means comprising holes 44 and 46 and a slot 48. Projection 38 of leaf 28 snap-fits or friction-fits into hole 44 in first shell 20 and projection 40 (not seen) of leaf 28 similarly snap-fits or friction-fits into a corresponding hole 46 (FIG. 4) in first shell 20, while a lip 42 of leaf 28 snap-fits or friction-fits into slot 48 in first shell 20, to thereby place leaf 28 and leaf 30 in their carrying position seen in FIGS. 1 and 2.

Figure 11:
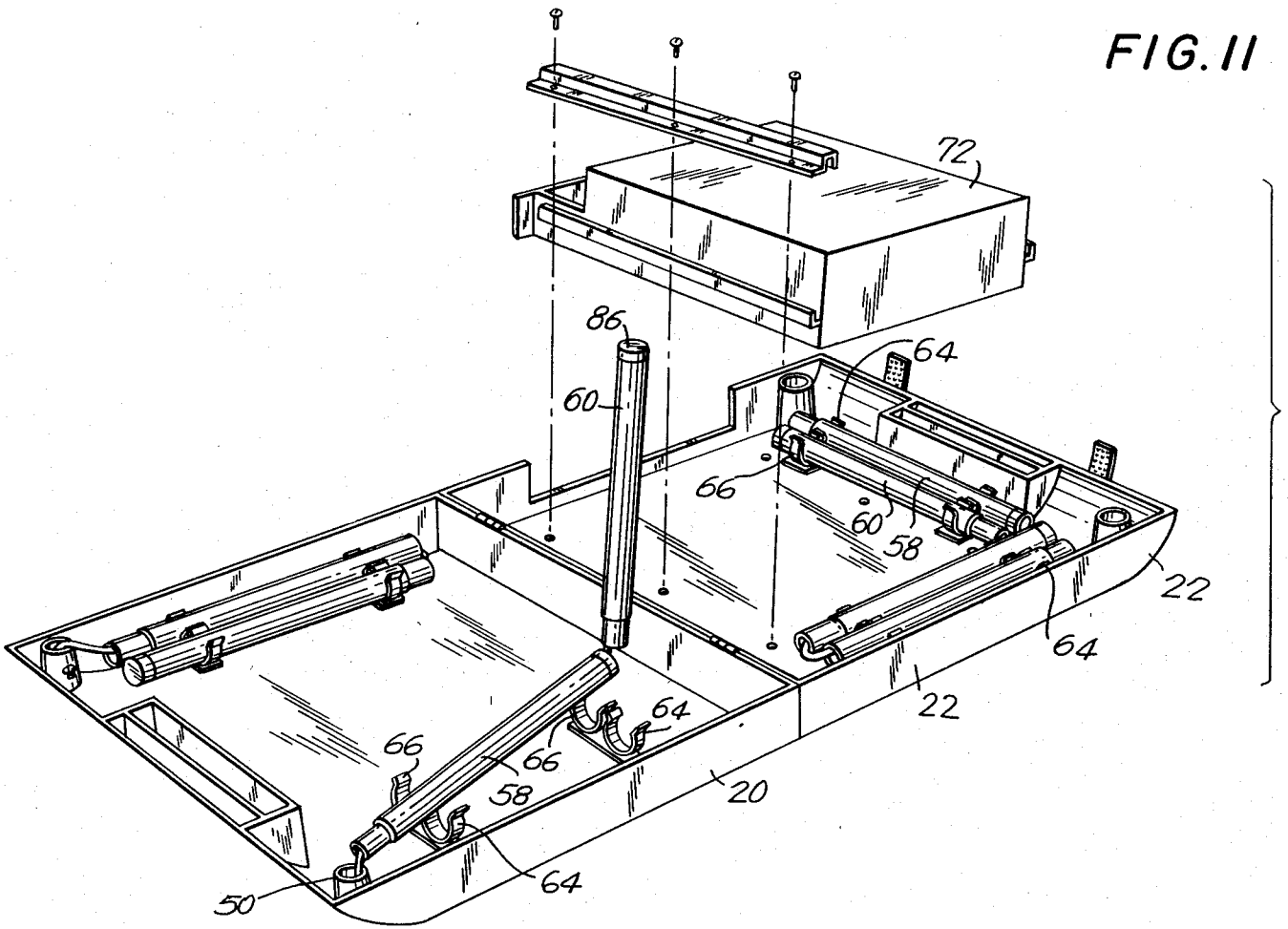
FIG. 11 is an exploded perspective view of the table shown in a partly collapsed state.
Figure 12:
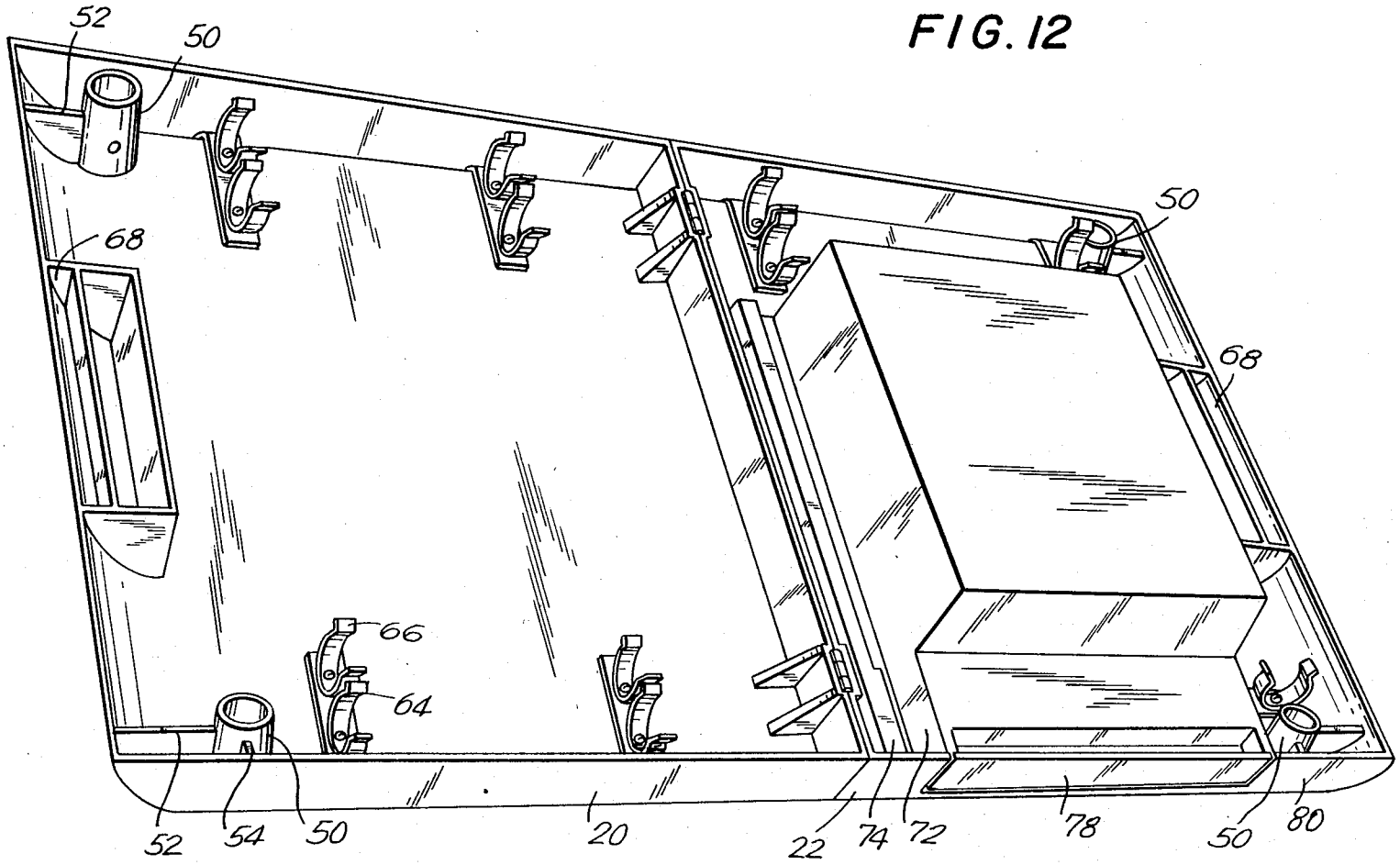
FIG. 12 is a perspective view similar to that of FIG. 11 but with some of the elements removed to show other elements more clearly.
Figure 15:
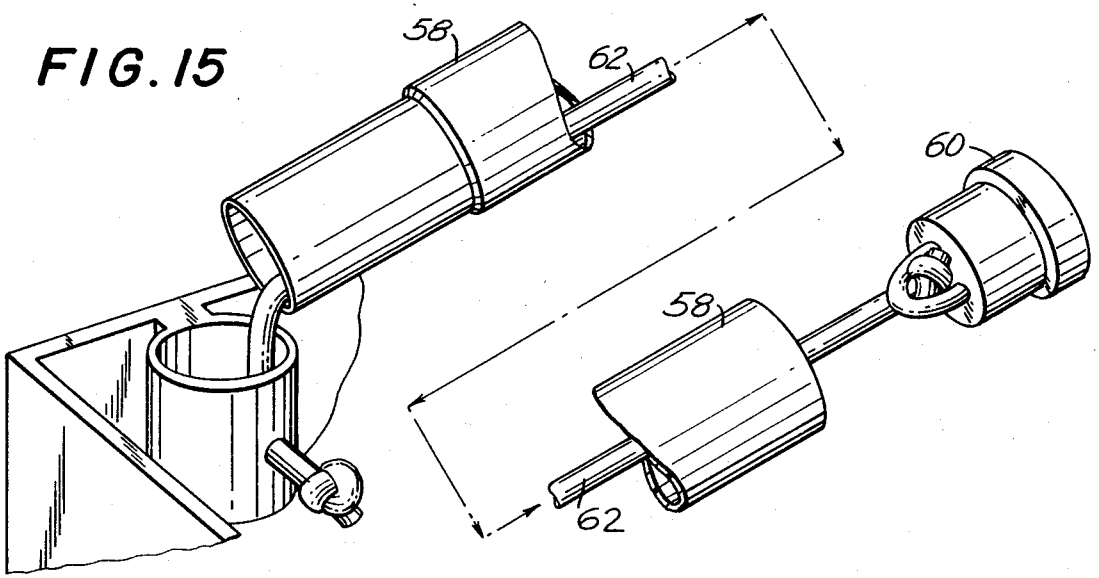
FIG. 15 is a perspective view illustrating how a table leg is secured to the table.
Figure 16:
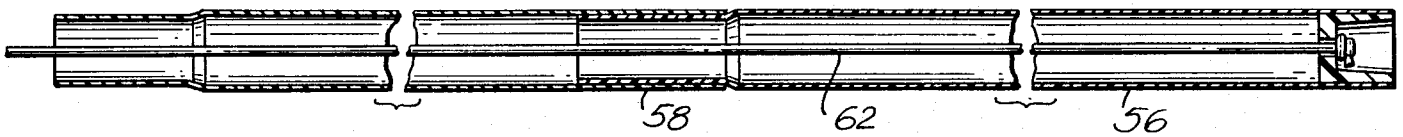
FIG. 16 is an axial sectional view through a table leg.

Referring to FIGS. 11 and 12, each of first shell 20 and second shell 22 has at its inner side leg engagement means in the form of a cylindrical, open bottom receptor 50 at each corner of the hinge sides 20*a* and 22*a* of each of first shell 20 and second shell 22. Each receptor 50 can be molded integrally with first shell 20 (or second shell 22, as the case may be) and each can be braced with an integrally molded rib 52 and an integrally molded rib 54. Each receptor 50 receives the upper end of an upper leg section 58, as illustrated in FIG. 15, and each upper leg section 58 receives at its lower end the upper end of a lower leg section 60 which interfits into the respective upper leg section 58. A respective resilient means such as a bungee cord 62 is secured to the inner center of each receptor 50 and to the lower end of the corresponding lower leg section 60 and is threaded through the corresponding upper leg section 58 and lower leg section 60. Each bungee cord 62 is stretched enough to urge the respective upper leg section 58 and lower leg section 60 toward each other and toward the respective receptor 50 to facilitate assembly and to keep the respective portions of each leg 56 together and attached to the respective receptor 50.

When the table is collapsed, each upper leg section 58 is detached from its respective receptor 50 (see FIG. 11) and each lower leg section 60 is detached from the corresponding upper leg section 58. As seen in FIGS. 11 and 12, upper leg sections 58 are provided at the inner side of first shell 20 and second shell 22 to engage each upper leg section 58 and leg section braces 66 are similarly provided to engage lower leg section 60. As best seen in FIG. 11, when stowed away the upper leg section 58 and lower leg section 60 for each leg 56 of first shell 20 are parallel to each other while the upper leg section 58 and lower leg section 60 for one leg 56 are normal to those of the other of second shell 22.

Each of first shell 20 and second shell 22 has a handle opening 68 (see FIGS. 12 and 13) and, when first shell 20 and second shell 22 are in their closed position (FIG. 2) the handle opening 68 of first shell 20 and second shell 22 join to form the opening of a handle 70 suitable for grasping by a person carrying the collapsed table with attached leaf 28 and leaf 28.

Figure 8:
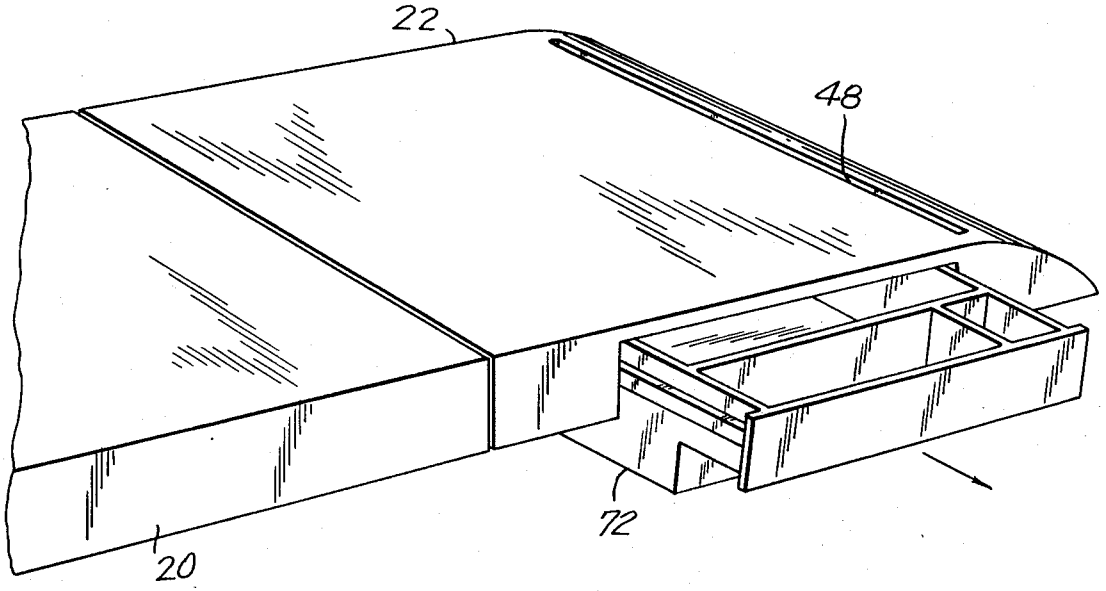
FIG. 8 is a perspective view showing a detail of a drawer assembly which is a part of the table.
Figure 9:
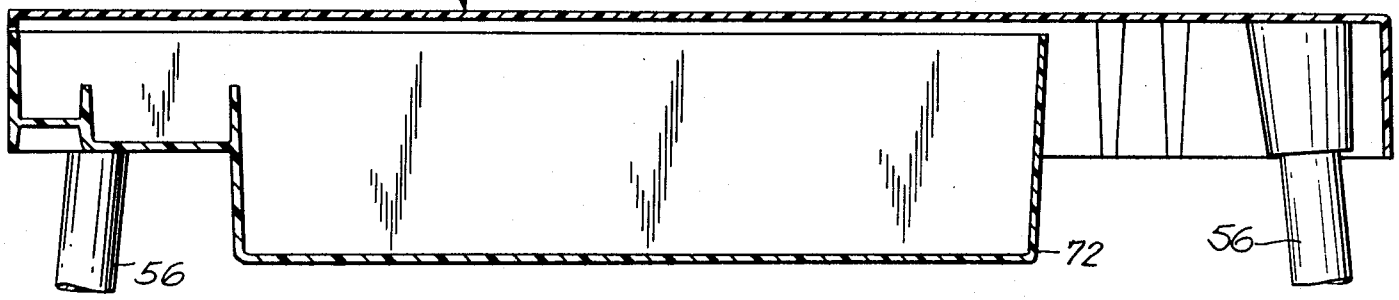
FIG 9 is a sectional view along line 9—9 of FIG. 4 showing the drawer.
Figure 10:
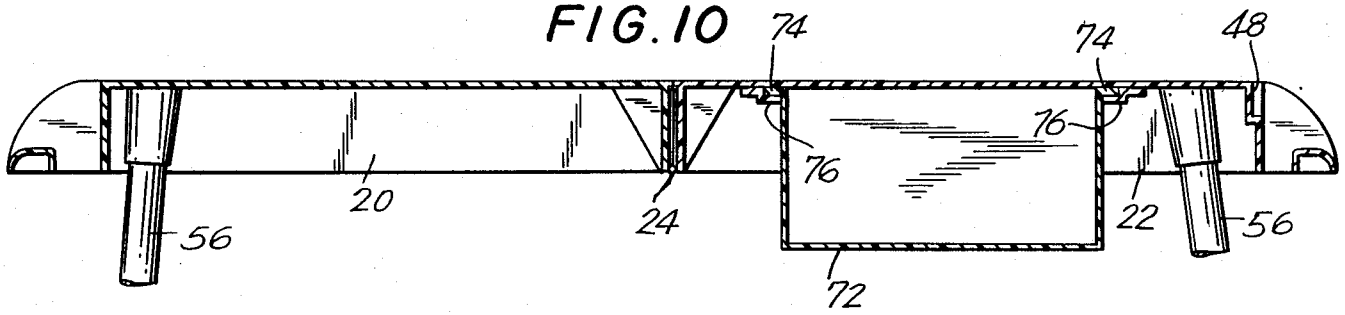
FIG. 10 is a sectional view along line 10—10 of FIG. 4 showing the drawer.

Second shell 22 includes a drawer 72 which can pull out as seen in FIG. 8, supported by the sliding engagement between side flanges 74 which are integral with drawer 72 and grooves 76 which are affixed to the inner side of second shell 22. As best seen in FIGS. 8 and 12, the bottom of drawer 72 is stepped so that the front wall 78 of drawer 72 is the same height and can be flush with the front wall 80 of second shell 22, to present a pleasing visual appearance, while the portion of drawer 72 which is set back a short distance from front wall 78 is deeper, to provide additional storage space. The relative dimensions are such that drawer 72 fits within the interior space defined by first shell 20 and second shell 22 when first shell 20 and second shell 22 are in their closed position shown in FIG. 2.

Figure 2:
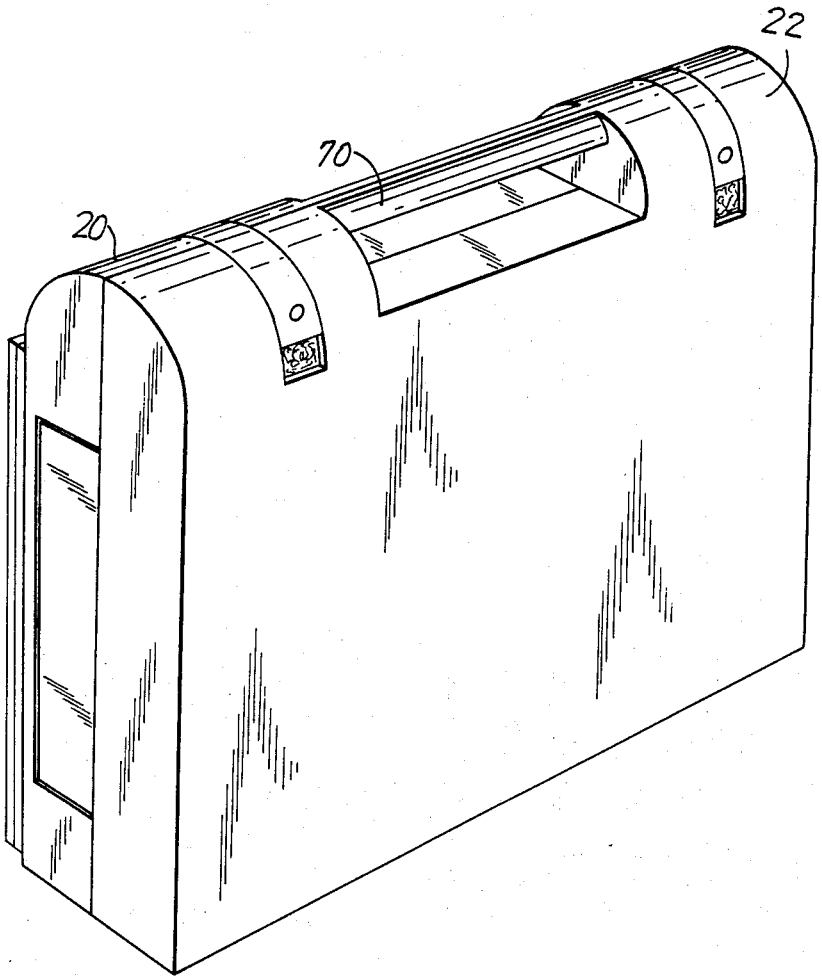
FIG. 2 is a perspective view of the closed table with attached backboard.

As seen in FIGS. 1 and 2, first shell 20 and second shell 22 can be secured in their closed position by means of locking straps 82. A pair of these locking straps 82 can be secured to recesses 84 in second shell 22 and can be in the form of Velcro material which mates with corresponding pieces of Velcro material secured in recesses 84 of first shell 20.

Figure 3:
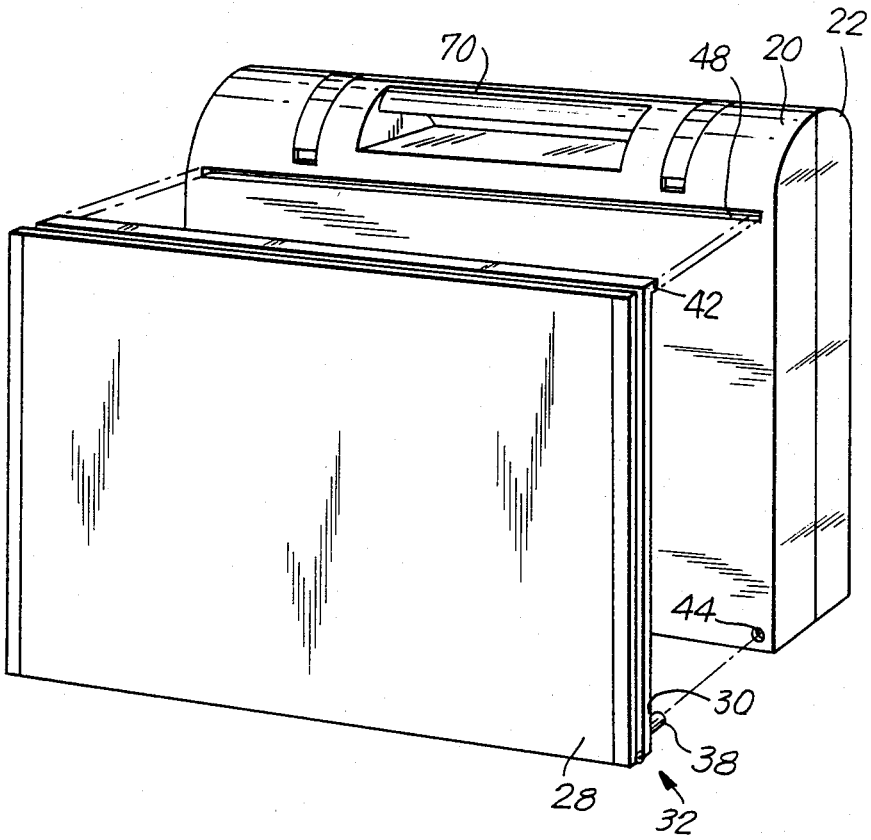
FIG. 3 is a perspective view of the closed table showing how it supports a folded backboard.
Figure 4:
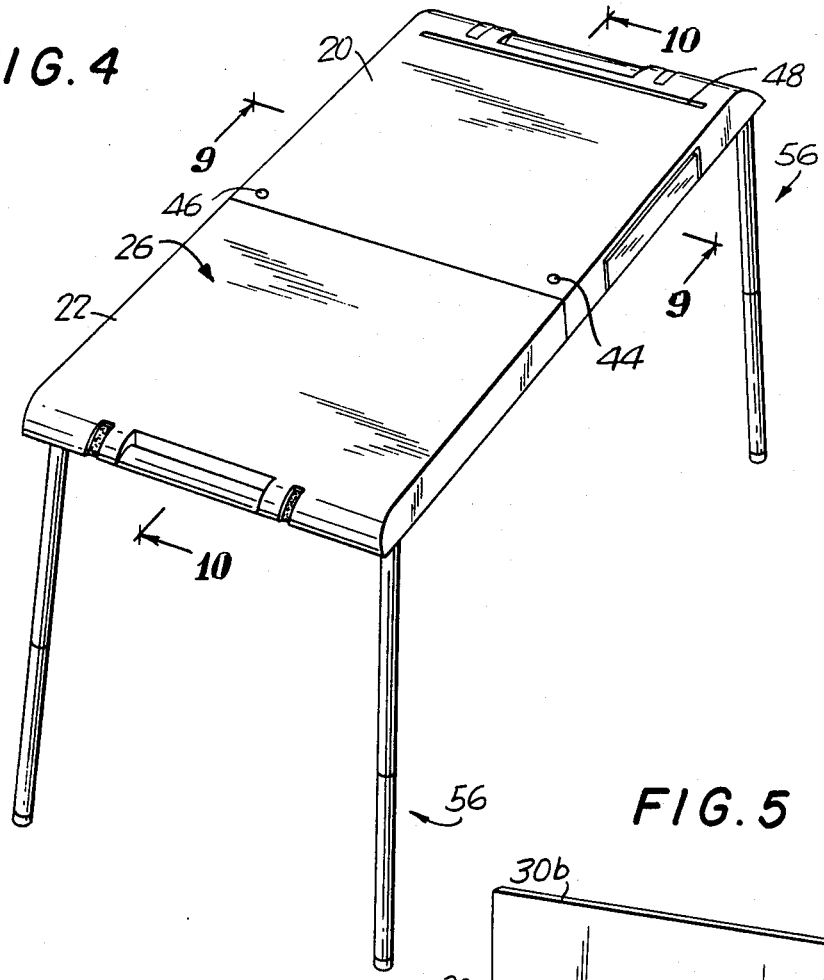
FIG. 4 is a perspective view of the open table, before the backboard is attached.
Figure 5:
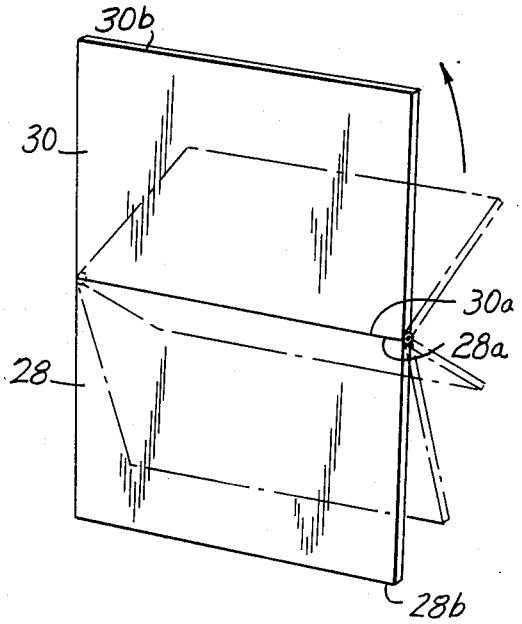
FIG. 5 shows the backboard in the process of being unfolded.
Figure 6:
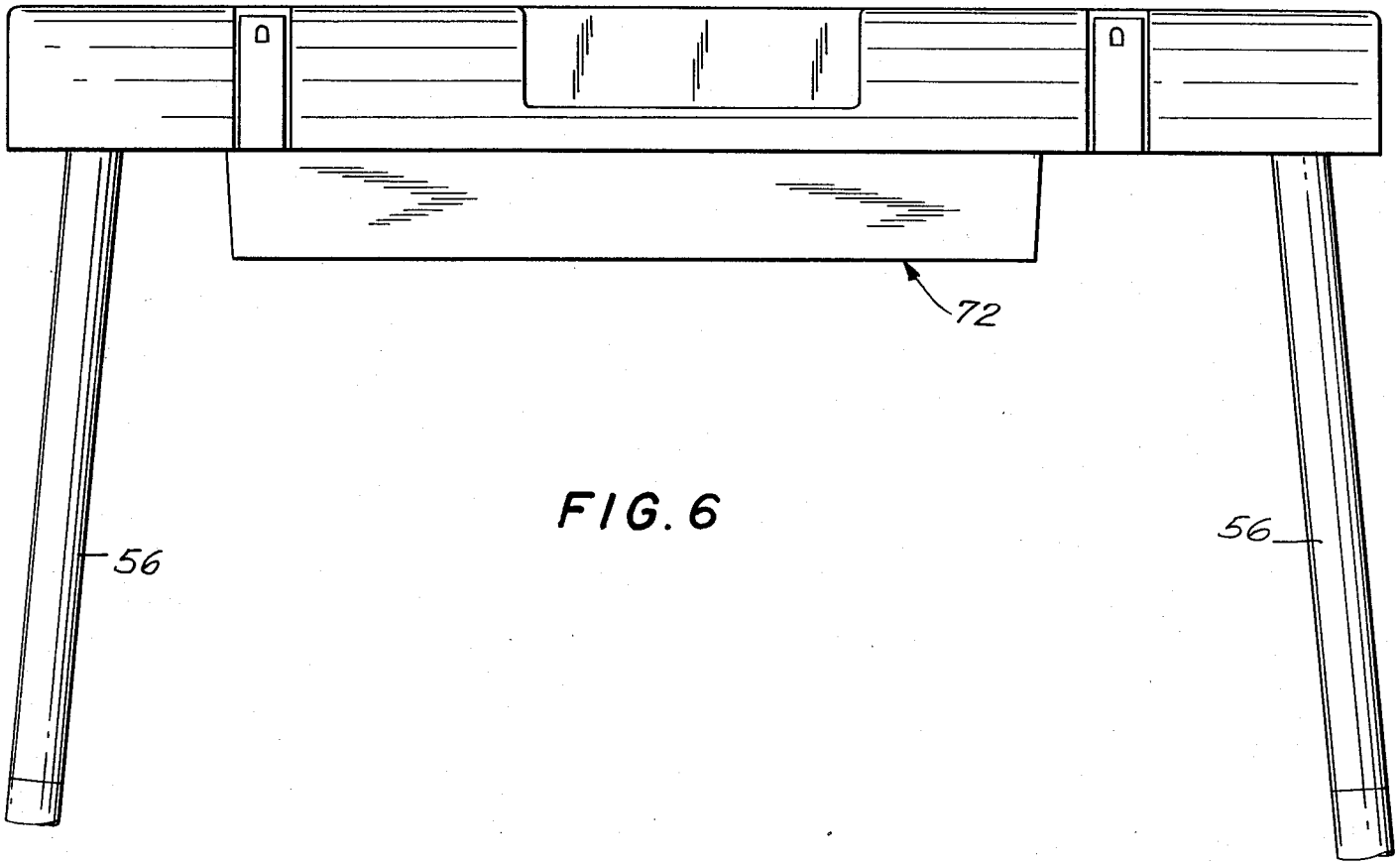
FIG. 6 is an end elevational view of the table.
Figure 7:
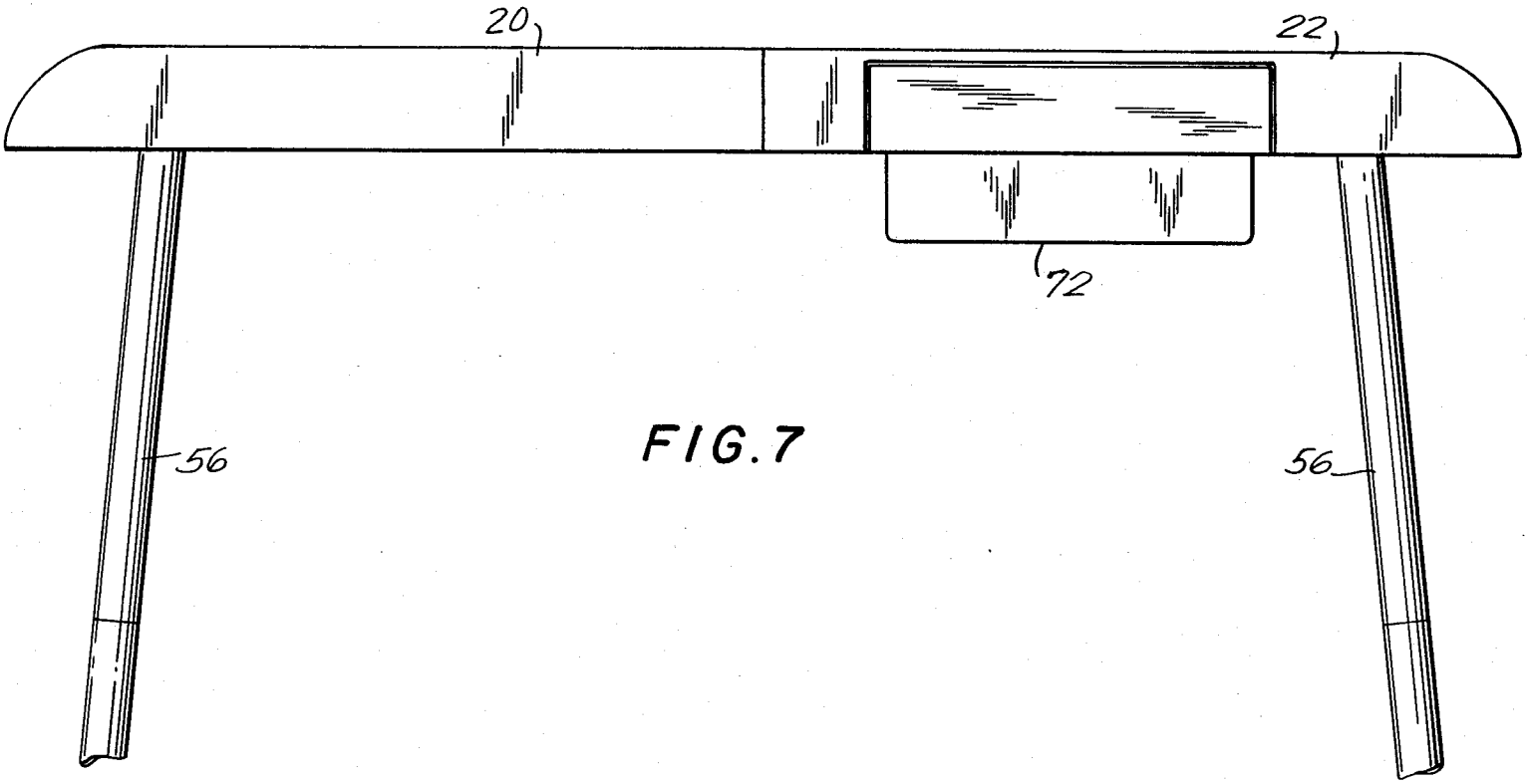
FIG. 7 is a side elevational view of the table.
Figures 13, 14:
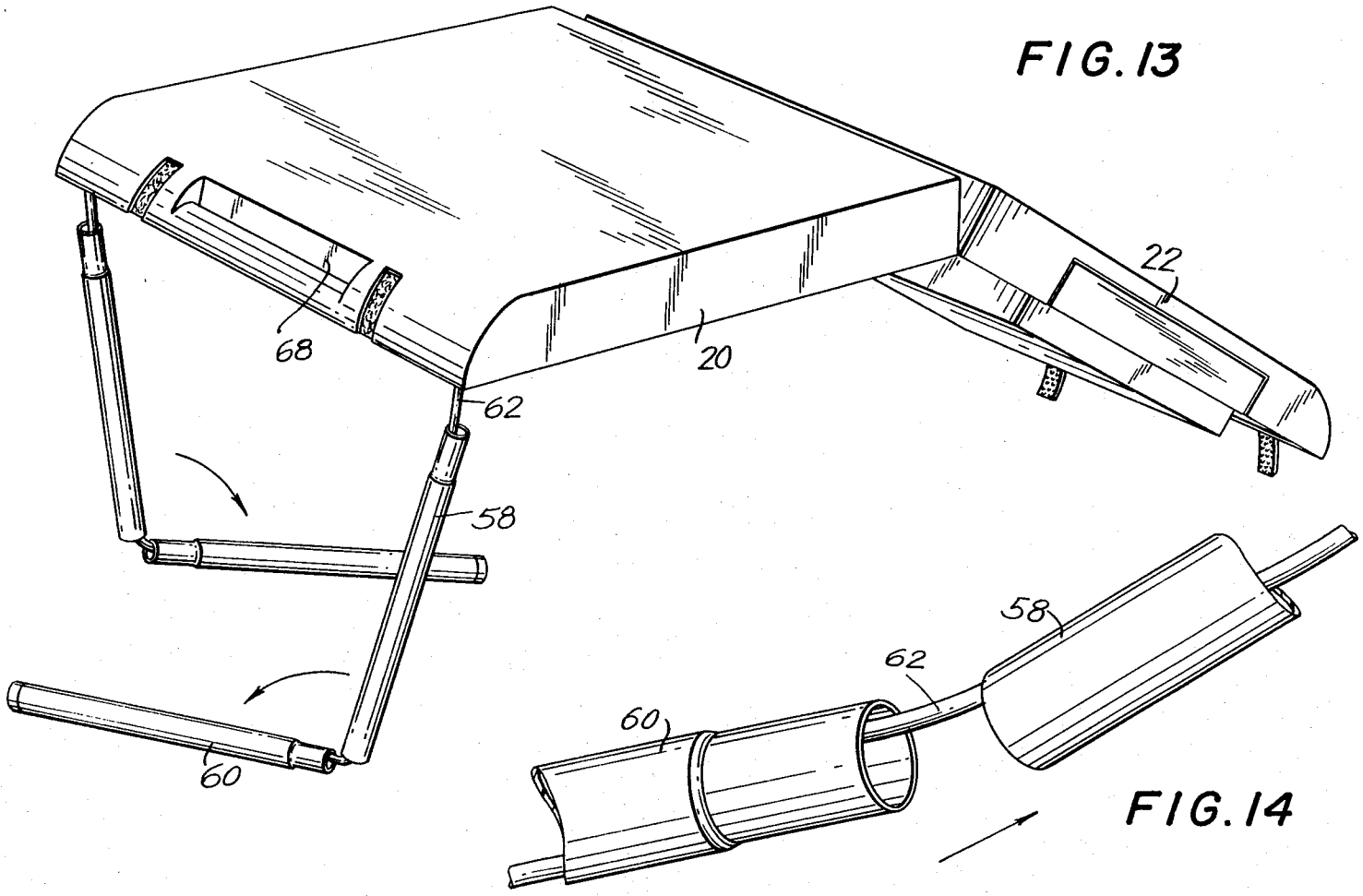
FIG. 13 is a perspective view showing the table as it is being opened.
FIG. 14 is a perspective view illustrating how sections of a table leg are assembled.

The demonstration table can be stored together with the folded backboard secured thereto, in the closed and locked form illustrated in FIG. 2, and can be carried in that form using handle 70. Note that in the closed position shown in FIG. 2, first shell 20 and second shell 22 completely enclose from all sides the interior space defined therebetween. To prepare the table and backboard for use in a demonstration, leaf 28 and leaf 30 are unsnapped from first shell 20, as seen in FIG. 3, locking straps 82 are freed as seen in FIG. 1 and first shell 20 and second shell 22 are pivoted to their open position about hinge 24, from the initial opening seen in FIG. 1, through the stage seen in FIG. 13, and finally to the completely open position seen in FIGS. 4 and 11. As seen in FIG. 11 (disregarding the exploded view of drawer 72), each leg 56 is unsnapped from its leg section braces 64 and is assembled by interfitting its upper leg section 58 and lower leg section 60 as seen in FIGS. 11 and 13, and is then fitted in receptor 50. A suitable foot cup 86 made of a material such as rubber or plastic can be secured at the bottom end of each leg 56. After each leg 56 is in position, the table can be turned over to the position shown in FIG. 4 and used as a demonstration table or for any other suitable purpose. The table can be used without a backboard, as seen in FIG. 4. In the alternative, it can be used with the display backboard 34 secured thereto, extending self-supported up from slot 48, with leaf 28 hinge 24 facing first shell 20 and display backboard 34 leaning away from first shell 20. Display backboard 34 can be provided with suitable means for attaching signs or merchandise thereto, as in known in the art. The table and display backboard 34 can be collapsed to the closed position for storage and carrying by carrying out these same steps in reverse order.

I claim:

1. A self-contained, collapsible demonstration table with a backboard which can be conveniently changed manually between a closed, suitcase-like structure that is easily stored and carried and a table with a large table top and an upstanding display backboard, comprising:

a housing having first and second shells each of which has a hinge side and a free side separated from each other by a table portion having an inner side and an outer side;

a shell hinge securing the hinge sides of said shells to each other to allow the shells to pivot between an open position in which the outer sides of said table portions thereof form a substantially flat table top and a closed position in which the shells form a closed, suitcase-like package in which the inner sides of said table portions are spaced from each other to enclose an interior space;

two leaves each having a hinge end and a free end;

a leaf hinge securing the hinge ends of said leaves to each other to allow the leaves to pivot between an open position in which said leaves form a display backboard and a folded position in which said leaves are folded flat against each other;

a backboard engaging means at said housing for detachably securing said backboard in a display position in which said backboard extends up from said table top;

a leaf engaging means at said housing for engaging said leaves when in their folded position to support them against the table portion of one of said shells when the shells are in their closed position;

leg engagement means at the inner side of each of said shells;

at least three legs each of which comprises an upper and a lower section which are secured to each other and to a respective leg engagement means by a respective resilient means which urges the respective leg sections and leg supporting means toward each other such that when the respective leg sections and leg engagement means are aligned the two sections of each leg detachably interfit to form a leg and the legs detachably interfit with the respective leg engagement means to thereby support said table and such that said legs can be detached from said leg engagement means and the sections of each leg can be detached from each other by hand against the urging of said resilient means;

leg section braces at the inner side of each of said shells to detachably secure said leg sections flat against the inner sides of said shells when the leg sections are detached from each other;

wherein said closed, suitcase-like package can be conveniently converted manually to a demonstration table with an upstanding display backboard by the steps of manually detaching the leaves, pivoting the shells to their open positions to form said table top, and detaching said leg sections from said braces and interfitting them with each other and with said leg engagement means to form table legs supporting the table top and pivoting the leaves to form said backboard and securing the backboard to said backboard engaging means, and wherein said table and backboard can be collapsed to form said closed, suitcase-like package by carrying out said steps in reverse order.

2. A table as in claim 1 in which each of said shells includes a handle portion at its free end and wherein said handle portions interfit when the shells are in their closed position to form a carrying handle.

3. A table as in claim 2 including straps secured to the free end of at least one of said shells for detachably engaging the other shell when the shells are in their closed position to keep said package closed.

4. A table as in claim 3 in which said free ends of the shells are rounded and said hinge ends are substantially flat so that when the shells are in their closed position the flat ends form a base on which the package can sit and said rounded ends form a rounded upper end of the package.

5. A table as in claim 4 in which one of said shells includes a drawer structure which is below the said table top when the shells are in their open position and fits within said interior space between the table portions when the shells are in their closed position.

* * * * *